US006450788B1

(12) United States Patent
Grabert

(10) Patent No.: US 6,450,788 B1
(45) Date of Patent: Sep. 17, 2002

(54) PISTON PUMP FOR HIGH-PRESSURE FUEL DELIVERY

(75) Inventor: Peter Grabert, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/806,715

(22) PCT Filed: Jun. 17, 1999

(86) PCT No.: PCT/DE99/01781

§ 371 (c)(1),
(2), (4) Date: Apr. 4, 2001

(87) PCT Pub. No.: WO00/23710

PCT Pub. Date: Apr. 27, 2000

(30) Foreign Application Priority Data

Oct. 17, 1998 (DE) ..... 198 48 040

(51) Int. Cl.[7] ..... F04B 39/10

(52) U.S. Cl. ..... 417/570; 417/549; 417/562; 417/569; 417/521; 417/559; 417/454; 417/470; 92/171.1; 123/450; 123/495

(58) Field of Search ..... 417/570, 549, 417/562, 569, 521, 559, 454, 470; 92/171.1; 123/450, 495

(56) References Cited

U.S. PATENT DOCUMENTS 3,912,421 A * 10/1975 Gelin ..... 417/273
5,358,383 A * 10/1994 Eisenbacher et al. ..... 417/273
5,571,243 A * 11/1996 Arnold et al. ..... 123/198 DB
6,186,120 B1 * 2/2001 Guentert et al. ..... 123/456
6,224,351 B1 * 5/2001 Simon et al. ..... 417/273
6,238,189 B1 * 5/2001 Guentert ..... 417/273
6,332,761 B1 * 12/2001 Guentert et al. ..... 137/539.5

* cited by examiner

*Primary Examiner*—Charles G. Freay
*Assistant Examiner*—Emmanuel Sayoc
(74) *Attorney, Agent, or Firm*—Ronald E. Greigg

(57) ABSTRACT

Disclosed is a piston pump having a pump housing with a cylinder head comprised of a first plate and a second plate. The plates which rest against each other and are screwed to the pump housing, have a first conduit which carries low-pressure fuel and leads to a first check valve disposed between the two plates. The check valve communicates with a cylinder chamber of the radial piston pump. A second conduit carrying high-pressure fuel leads from this cylinder chamber to a second check valve, which is disposed between the first plate and the pump housing. Seals that are appropriate to the load, in fact low-pressure seals, are provided in the region of the cylinder head that is subjected to low pressure and high-pressure seals are provided in the region of the cylinder head that is subjected to high pressure.

5 Claims, 1 Drawing Sheet

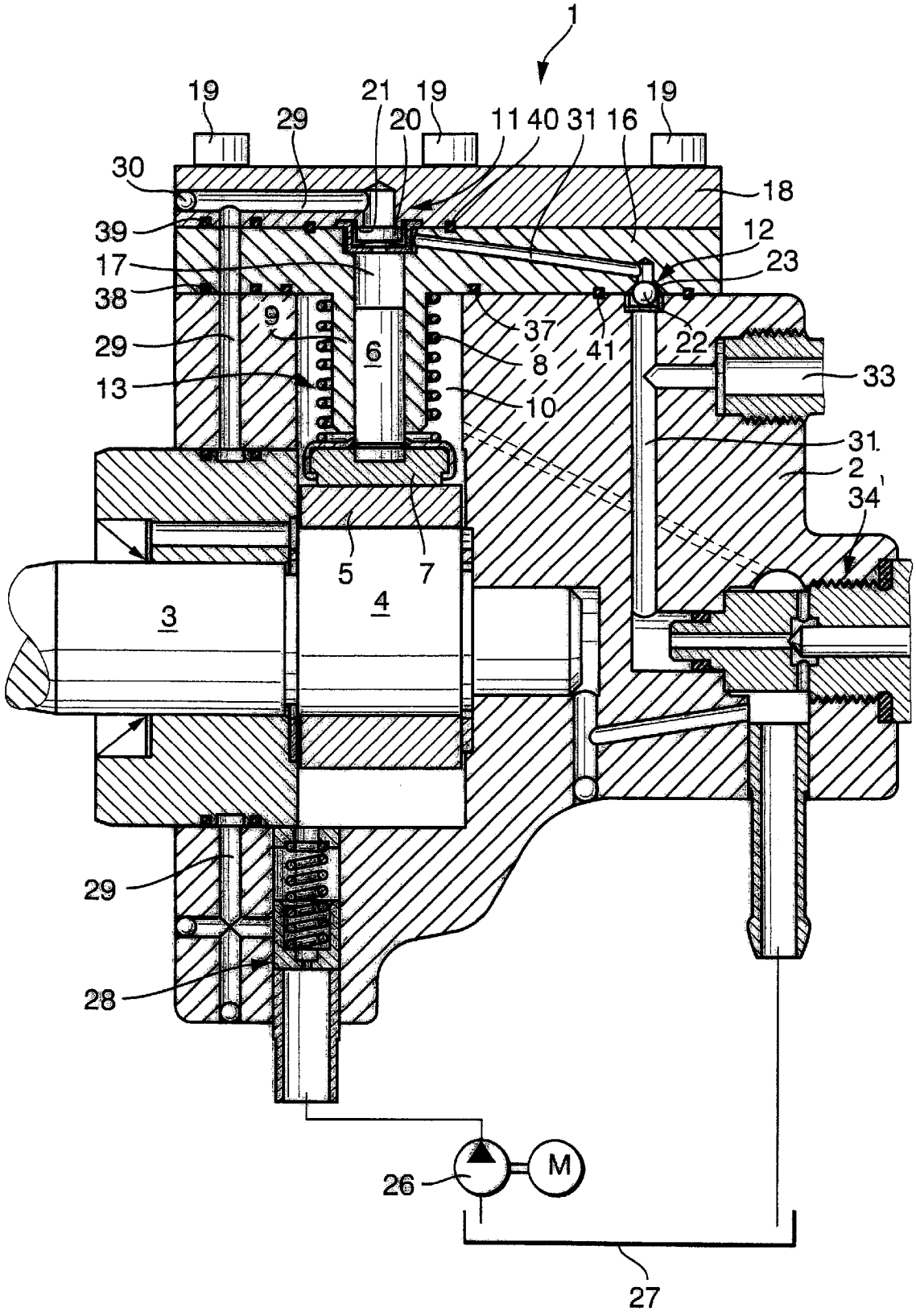
1
19
21
19
19
29
20
11
40
31
16
30
18
39
12
17
23
38
9
37
41
22
29
6
8
33
13
10
31
2
34
5
7
4
3
29
28
26
M
27

PISTON PUMP FOR HIGH-PRESSURE FUEL DELIVERY

CROSS-REFERENCE TO RELATED APPLICATIONS

This application is a 35 USC 371 application of PCT/DE 99/01781 filed on Jun. 17, 1999.

BACKGROUND OF THE INVENTION

1. Field of the Invention

The invention relates to a high pressure piston pump and more particularly, to a piston pump especially useful for high pressure delivery of fuel in fuel injection systems of internal combustion engines.

2. Description of the Prior Art

A piston pump of this kind has been disclosed in (DE 44 01 074 A1). In this known pump, a first plate is embodied in the shape of a flange with a central cylinder, which has a pump piston and is aligned radially in relation to a drive shaft of the pump, and approximately half of its plate thickness is contained in a countersink of a pump housing. A valve plate is supported on the side of the first plate oriented away from the shaft and has a first and a second check valve. The first plate and the valve plate are covered by a second plate that closes off the pump housing and is screwed to the pump housing. The second plate contains a conduit that carries low-pressure fuel and communicates at one end with a conduit of the pump housing and communicates at the other end with the first check valve. Between the pump housing and the second plate, a rubber elastic shaped seal, which encloses both the conduit and the flange-shaped first plate, is contained in a recess of the second plate. A second conduit, which leads from the second check valve and carries high-pressure fuel, transitions from the second plate into the pump housing by means of a connecting piece. The connecting piece is embodied as socket-shaped and engages in both the second plate and the pump housing. The connecting piece is sealed in relation to the second plate and the pump housing by means of annular, rubber elastic high-pressure seals.

In the known radial piston pump, the second plate is represented as resting completely against the pump housing. In actual use, however, a gap of a few tenths of a millimeter must be provided between the plate and the pump housing in order to compensate for tolerances of the interconnected components—the pump housing, first plate, valve plate, and second plate—as well as to produce a play-free and fuel-tight placement of the first plate against the pump housing and of the valve plate between the first plate and the second plate.

Because of this design of the radial piston pump, assembly errors can occur which can impair the pump function or can cause the pump to fail. For example, potential errors include incorrect insertion of the shaped seal into the recess in the second plate resulting in a cross sectional reduction of the first conduit, tilting of the connecting piece in the course of the second conduit resulting in a leak as well as a skewed positioning of the second plate, wherein the latter error can also be caused by uneven screwing of the second plate to the pump housing.

SUMMARY OF THE INVENTION

The piston pump according to the invention, has the advantages over the prior art that fewer structural components are used than in the known prior art, that a definite geometrical association of the two plates that rest flat against each other is achieved, and that the second check valve is disposed in a favorable position from a production and assembly engineering standpoint.

In addition, seals are used which are advantageously adapted with regard to sealing in a manner consistent with the installation location and the load.

BRIEF DESCRIPTION OF THE DRAWING

An exemplary embodiment of the invention will be explained in detail in the description, taken below in conjunction with the single drawing FIGURE depicting a radial piston pump shown in a simplified sectional view.

DESCRIPTION OF THE EXEMPLARY EMBODIMENT

A radial piston pump 1 embodied as a high-pressure pump is provided for high-pressure fuel delivery in fuel injection systems, particularly in a common rail injection system. The radial piston pump 1 has a pump housing 2 with a drive shaft 3 supported in it, which has a cam section 4 which supports a stroke ring 5. A sliding shoe 7 connected to a pump piston 6 is supported on the stroke ring 5 and is subjected to the action of a compression spring 8. The pump piston 6, which can be moved longitudinally by means of the cam section 4 of the drive shaft 3, is guided in a cylinder 9, which protrudes into an inner chamber 10 of the pump housing 2. The pump piston 6, the sliding shoe 7 and the cylinder 9, in connection with a first suction-side check valve 11 and a second pressure-side check valve 12, constitute a pump element 13 of the radial piston pump 1. This pump is equipped preferably with two additional pump elements 13, which are disposed in a common plane radial to the drive shaft 13 and are offset from one another by 120°.

The pump housing 2 is closed off from the inner chamber oriented toward the drive shaft by means of a first plate 16 extending at right angles to the pump piston axis. The first plate 16 rests essentially completely against the pump housing 2. The cylinder 9 is embodied on the first plate 16 so that it is of one piece with it. A cylinder chamber 17 containing the pump piston 6 continues in the first plate 16. The compression spring 8 that engages the sliding shoe 7 of the pump piston 6 is also supported against the first plate 16. On the side oriented away from the housing, the first plate 16 is covered by a second plate 18, which closes off the cylinder chamber 17. The second plate 18 rests congruently and essentially completely against the first plate 16. The two plates 16 and 18 are connected to the pump housing 2 with screws 19.

The first check valve 11 that communicates with the cylinder chamber 17 is disposed between the first plate and the second plate 18. It has a spring-loaded, disk-shaped closing body 20, which is associated with a flat valve seat 21 on the second plate 18. The second plate 18 is therefore hardened at least in the vicinity of the valve seat 21. The second check valve 12 is disposed between the first plate 16 and the pump housing 2. It has a ball-shaped closing body 22 with a hollow, conical valve seat 33. This valve seat is embodied in the first plate 16 and the first plate is hardened at least in the vicinity of this valve seat.

The radial piston pump 1 can be supplied with fuel by means of a low-pressure feed pump 26, for example from a diesel fuel tank 27 of a motor vehicle. To this end, the low-pressure feed pump 26 is connected to an overflow valve 28 disposed in the pump housing 2 of the radial piston pump 1. The overflow valve 28 communicates with a first conduit 29 which is embodied in the pump housing 2, penetrates the first plate 16 at right angles to its plane, and feeds into the second plate 18. The first conduit 29 continues in the second plate 18, extending in its plane, and comes to an end after a 90° turn at the first check valve 11. The first conduit 29, embodied as a circular, cylindrical bore, is closed tight in the second plate 18 by means of a press-fitted ball 30. The first conduit 29 feeds into the cylinder chamber 17 in the center of the valve seat 21 of the first check valve 11. A second conduit 31, which extends obliquely in the first plate 16, leads from the cylinder chamber 17 to the second check valve 12, feeding into the center of its valve seat 23. In the vicinity of the first plate 16, the second conduit 31 has no connections, which lead to the outside of the radial piston pump 1 and must be sealed. After the first plate 16, the second conduit 31 continues inside the pump housing 2, where it communicates with a connection 33 for a high-pressure fuel reservoir and with an electromagnetically controllable pressure control valve 34 (only partially depicted) that has a downstream connection to the diesel fuel tank 27.

During operation of the low-pressure feed pump 26 and the radial piston pump 1, the two plates 16 and 18 that constitute a cylinder head are subjected to the pressure of the supplied fuel; the first conduit 29 carries low-pressure fuel at approx. 10 bar, the second conduit 31 carries high-pressure fuel at approx. 1400 bar. The radial piston pump 1 is therefore provided with suitable sealing means appropriate to the load: a first low-pressure seal 37 is disposed between the pump housing 2 and the first plate 16. The low-pressure seal 37 is preferably embodied as a rubber elastic O-ring and is contained in a circumferential groove of the first plate 16, concentric to the cylinder 9 and spaced apart from it. In a corresponding way, a second low-pressure seal 38 is disposed in the first plate 16 and a third low-pressure seal 39 is disposed in the second plate 18, which respectively encompass only the first conduit 29 and are likewise embodied as rubber elastic O-rings. A first high-pressure seal 40 is disposed between the first plate 16 and the second plate 18 and concentrically encompasses the first check valve 11 and the cylinder chamber 17. A second high-pressure seal 41 is disposed between the first plate 16 and the pump housing 2. It encompasses only the second check valve 12. The high-pressure seals 40 and 41 can be embodied as metallic seals; for example, they can be embodied as biting edge seals. In the drawing, the low-pressure seals 37, 38, 39 and the high-pressure seals 40, 41 are only depicted symbolically.

The foregoing relates to preferred exemplary embodiments of the invention, it being understood that other variants and embodiments thereof are possible within the spirit and scope of the invention, the latter being defined by the appended claims.

I claim:

1. A piston pump (1) for high-pressure fuel delivery in rail injection fuel systems of internal combustion engines comprising:

a pump housing (2), said pump housing (2) being closed off from an internal chamber (10) by means of a first plate (16), which first plate essentially rests against the pump housing completely and in which a cylinder chamber (17) is embodied that contains a pump piston (6), said first plate (16), on the side oriented away from said housing, being covered by a second plate (18) that closes off said cylinder chamber (17), a first check valve (11) between said first plate (16) and said second plate (18), said first check valve being connected to said cylinder chamber (17), said second plate (18) having a first conduit (29) formed thereon extending predominantly in its plane and carrying low-pressure fuel, which first conduit starts at said pump housing (2) and ends at said first check valve (11), a second conduit (31), which carries high-pressure fuel leading from the cylinder chamber (17) and in its continued course, has a second check valve (12) after which said second conduit (31) continues inside said pump housing (2), low-pressure seals (37, 38, 39) and high-pressure seals (40, 41) being disposed between said pump housing (2) and said plates (16, 18), said first plate (16) and said second plate (18) being embodied so that they essentially rest completely against each other, said first conduit (29) having a section which passes through said first plate (16), at a location between said pump housing (2) and said second plate (18), said second check valve (12) being disposed between said first plate (16) and the pump housing (2), and said second conduit (31) being embodied in said first plate, between said cylinder chamber (17) and the second check valve (12).

2. The piston pump according to claim 1, wherein said low-pressure seals (37, 38, 39) are disposed between said pump housing (2) and said first plate (16), encompassing only said cylinder chamber (17) and only said first conduit (29), as well as between said first plate (16) and said second plate (18), encompassing only said first conduit (29), and said high-pressure seals (40, 41) being disposed between said first plate (16) and said second plate (18), encompassing only said cylinder chamber (17) and said first check valve (11), as well as between said first plate (16) and said pump housing (2), encompassing only said second check valve (12).

3. The radial piston pump according to claim 2, wherein said low-pressure seals (37, 38, 39) are embodied as O-rings.

4. The radial piston pump according to claim 2, wherein said high-pressure seals (40, 41) are metallic seals.

5. The radial piston pump according to claim 4, wherein said high-pressure metallic seals (40, 41) are embodied as biting-edge seals.

* * * * *